US008963033B2

(12) United States Patent
Kiple et al.

(10) Patent No.: US 8,963,033 B2
(45) Date of Patent: Feb. 24, 2015

(54) CAM-ACTION ANTI-ROLL BUTTON

(75) Inventors: Bryan Patrick Kiple, Los Gatos, CA (US); Jared M. Kole, San Jose, CA (US); Michael Wittenberg, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 117 days.

(21) Appl. No.: 13/228,557

(22) Filed: Sep. 9, 2011

(65) Prior Publication Data

US 2013/0062174 A1 Mar. 14, 2013

(51) Int. Cl.
*H01H 13/70* (2006.01)
*H01H 13/84* (2006.01)

(52) U.S. Cl.
CPC ..... *H01H 13/84* (2013.01); *H01H 2221/026* (2013.01); *H01H 2221/03* (2013.01); *H01H 2221/058* (2013.01); *H01H 2227/034* (2013.01)
USPC ..... 200/344

(58) Field of Classification Search
USPC ..... 200/341, 344
See application file for complete search history.

(56) References Cited

U.S. PATENT DOCUMENTS

| | | | | |
|---|---|---|---|---|
| 4,392,037 | A | 7/1983 | Fleming | |
| 5,463,742 | A | 10/1995 | Kobayashi | |
| 5,631,643 | A | 5/1997 | Hisamori et al. | |
| 5,929,405 | A | 7/1999 | Wehrli, III et al. | |
| 5,941,373 | A * | 8/1999 | Cheng | 200/344 |
| 6,057,522 | A * | 5/2000 | Chao | 200/344 |
| 6,418,534 | B1 | 7/2002 | Fogle | |
| 6,437,269 | B1 | 8/2002 | Rakus | |
| 6,574,517 | B1 | 6/2003 | Park et al. | |
| 6,615,287 | B1 | 9/2003 | Behrens et al. | |
| 6,996,705 | B2 | 2/2006 | Cheston et al. | |
| 7,038,665 | B1 | 5/2006 | Pandana | |
| 7,209,124 | B2 | 4/2007 | Hunt et al. | |
| 7,289,813 | B2 | 10/2007 | Karaoguz | |
| 7,316,648 | B2 | 1/2008 | Kelly et al. | |
| 7,865,640 | B1 | 1/2011 | Lewis et al. | |
| 7,873,764 | B2 | 1/2011 | Bica | |
| 7,987,421 | B1 | 7/2011 | Timothy et al. | |
| 8,321,810 | B2 | 11/2012 | Heintze | |
| 2004/0064199 | A1 | 4/2004 | Asoh et al. | |
| 2004/0104941 | A1 | 6/2004 | Natoli | |
| 2007/0063860 | A1 | 3/2007 | Escobosa et al. | |
| 2008/0132243 | A1 | 6/2008 | Spalink et al. | |
| 2008/0165035 | A1 | 7/2008 | Bhella et al. | |

(Continued)

OTHER PUBLICATIONS

Author Unknown, "iGPS—Large Scale Metrology," http://www.mikonmetrology.com/_template.php?id=47&lang+&print=1, 1 page, at least as early as Dec. 31, 2009.

(Continued)

*Primary Examiner* — Vanessa Girardi
(74) *Attorney, Agent, or Firm* — Brownstein Hyatt Farber Schreck, LLP

(57) ABSTRACT

A cam-action anti-rolling mechanism for buttons is described herein. One embodiment may take the form of a button having a body with a slot extending therethrough. The slot has a normal orientation to a direction of motion for the button. The button also includes a cam bar having a first portion extending through the slot and a second portion offset from and parallel to the first portion. The cam bar is coupled in a slip fit manner within the slot to the body and the second portion provides a rotational axis for the cam bar. A fixture coupled to the second portion of the cam bar is provided to allow for rotation of the cam bar.

19 Claims, 7 Drawing Sheets

(56) References Cited

U.S. PATENT DOCUMENTS

| | | | |
|---|---|---|---|
| 2009/0011707 | A1 | 1/2009 | Ko et al. |
| 2009/0175561 | A1 | 7/2009 | Lankswert |
| 2009/0186575 | A1 | 7/2009 | Perpinya et al. |
| 2009/0187677 | A1 | 7/2009 | Hunt et al. |
| 2010/0185785 | A1 | 7/2010 | Wu et al. |
| 2010/0286983 | A1 | 11/2010 | Cho |
| 2011/0162035 | A1 | 6/2011 | King et al. |
| 2011/0162048 | A1 | 6/2011 | Bilbrey et al. |
| 2013/0145061 | A1 | 6/2013 | Parivar et al. |

OTHER PUBLICATIONS

Stettner et al., "Three Dimensional Flash Ladar Focal Planes and Time Dependent Imaging," Advanced Scientific Concepts, Inc., 5 pages, at least as early as Dec. 31, 2009.

Universal Serial Bus (USB), Devices Class Definition for Human Interface Devices (HIP) Firmwave Specification, USB Implementers Forum, Version 1.1, XP0030133256, 96 pages, Jun. 27, 2001.

* cited by examiner

CAM-ACTION ANTI-ROLL BUTTON

TECHNICAL FIELD

The present application generally relates to mechanical buttons and, more particularly, to anti-roll mechanisms for buttons.

BACKGROUND

The operation or actuation of a mechanical button generally entails the displacement of the button by force. A button may include mechanisms to oppose this force and return the button to a resting position when the force is removed, one example of which is a spring. Often the force is not applied to an area of the button that is directly over the spring, or is not applied in a direction that is in-line with the motion of the spring. Such applications of force may cause the button to roll about an axis, thereby depressing one side of the button more than another. Elongated buttons, such as a space bar, may have multiple springs and other mechanisms to help prevent and/or reduce roll, thereby ensuring that the button moves a uniformly. Typically, anti-roll mechanisms are bulky and include a relatively large coordinated support system. With the ever-decreasing size of electronic devices, the installation of such mechanisms may become impractical or may consume space inside an electronic device that would otherwise be put to a different use.

SUMMARY

Embodiments of a cam-action, anti-rolling mechanism for use with a button are described herein. One embodiment may take the form of a button having a body with a slot extending therethrough. The slot has a orthogonal orientation to a direction of motion for the button. The button also includes a cam bar having a first portion extending through the slot and a second portion offset from and parallel to the first portion. The cam bar is coupled in a slip fit manner within the slot to the body and the second portion provides a rotational axis for the cam bar. A fixture coupled to the second portion of the cam bar is provided to allow for rotation of the cam bar.

Another embodiment may take the form of a cam action anti-roll button having an elongated body with an aperture extending lengthwise therethrough. The button includes a cam bar extending through the aperture and coupled thereto in a slip fit manner. The cam bar is configured to move within the aperture as the button moves within its axis of motion. Additionally, the button includes a cam member coupled to the cam bar. The cam bar extends in a substantially perpendicular manner from the cam member in a first direction. A rotational bar is coupled to the cam member and extends in a substantially perpendicular manner from the cam member in an opposite direction from the first direction. The rotational bar is offset from and parallel to a line that contains the cam bar.

In yet another embodiment, a method of manufacture may include forming an elongated button body having a slot extending therethrough lengthwise and inserting a cam bar into the slot. The cam bar extends through the slot. The method includes rotationally coupling a rotating bar to a rotating point, wherein the rotating bar is coupled to the cam bar via a cam member. Further, the method includes installing a switch under the elongated body such that external pressure on the body actuates the switch. The external pressure is opposed by the cam bar and causes the cam bar to displace laterally within the slot.

While multiple embodiments are disclosed, still other embodiments of the present invention will become apparent to those skilled in the art from the following Detailed Description. As will be realized, the embodiments are capable of modifications in various aspects, all without departing from the spirit and scope of the embodiments. Accordingly, the drawings and detailed description are to be regarded as illustrative in nature and not restrictive.

DETAILED DESCRIPTION

Figure 1:
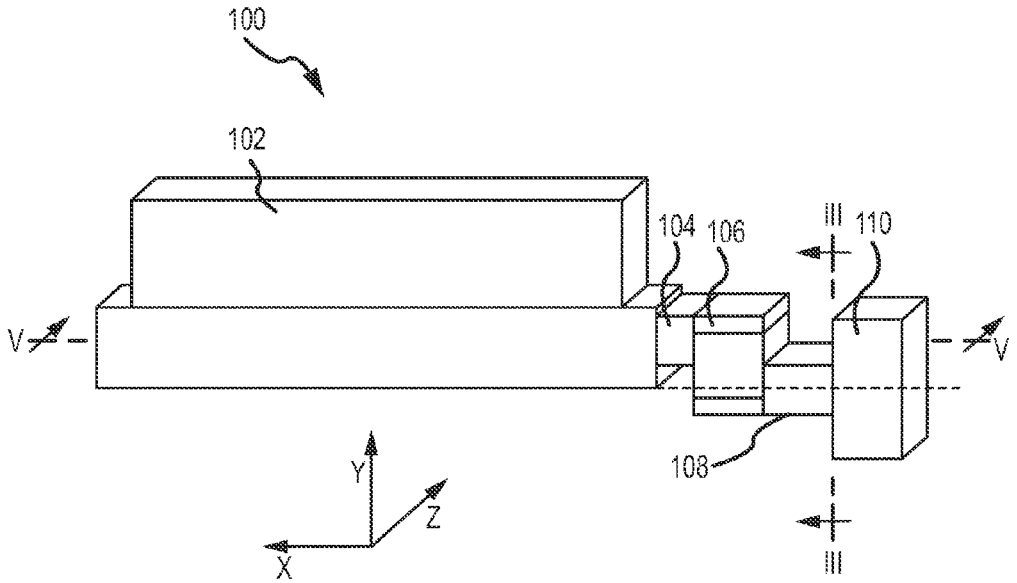
FIG. 1 illustrates a cam action, anti-roll button.

A one-sided, cam-action button mechanism is disclosed that prevents roll of a button. In some embodiments, a cam mechanism is coupled to a product housing in a manner that allows for rotation about a rotation axis. A cam bar is offset but parallel to this axis and may be a cylindrical rod that projects through a slot in the body of the button in a slip fit manner. The slot in the button is both normal to the direction of button actuation and normal to a roll axis of the button. As force is applied to the button, the cam bar travels with the button, forcing the cam to rotate about its rotation axis. This is true regardless of where along the length of the button the pressure is applied. Due to the slip fit between the cam bar and the button, the button is constrained to travel along the switch axis without moving about the roll axis.

Generally, the button includes an oval shaped aperture or slot that extends through the button and may be positioned anywhere within the button relative to a keycap or other impact surface of the button. The cam bar is inserted through the aperture and extends the entire, or substantially the entire, length of the aperture. The cam bar may be mechanically coupled to a cam mechanism. A rotation bar may also be coupled to the cam mechanism. The rotation bar and the cam bar are generally normal to the plane of the cam mechanism and extend in opposite directions from the cam mechanism.

The cam bar and the rotation bar are offset from each other so that they are not coaxial. For example and in one embodiment, the cam mechanism may take the form of a cam plate. The cam bar may be coupled to a first peripheral portion of the cam plate while the rotation bar is coupled to a second peripheral portion of the cam plate that is offset from the first peripheral portion. For example, the first peripheral portion of the cam plate may be in a top right corner of the cam plate while the second peripheral portion of the cam plate is in the lower left corner. In another embodiment, the cam mechanism may take the form of an s-shaped bar that joins the cam bar and the rotation bar so that they extend in opposite directions but lie in parallel lines. In some embodiments, the cam bar and the rotation bar may be opposite ends of an elongate member that has an s-curve.

The rotation bar may be coupled to a fixture that is configured also to couple to a housing. With the rotation bar coupled to the housing via the fixture, the rotation bar provides an axis of rotation for the cam bar when the button is depressed. Additionally, as the button is depressed the cam bar moves within the aperture of the button to accommodate the downward motion of the button.

Compared with other anti-roll button mechanisms, the embodiments discussed herein provide a one-sided device with a single interface that controls the anti-rolling scheme. This may permit tighter control of dimensions and assembly. Additionally, due to the tighter control and the one-sided, single interface, the present mechanism can fit into tighter spaces, especially thickness constrained spaces, as the mechanism is located to the side of the button, rather than under the button. Moreover, the anti-roll mechanism can be remotely located with respect to the switch, allowing for assembly in width-constrained products. This may provide greater flexibility in design and assembly of certain electronic devices, such as mobile electronic devices (e.g., smart phones, tablet computing devices, laptop computers and the like). Also, the fixture may be inserted after the button and the switch and, therefore, may be used to fine-tune the fit of the button. Further, the anti-roll feature will work regardless of where the cam slot is relative to the key cap.

Turning to the drawings and referring initially to FIG. 1, a cam action anti-roll button 100 is illustrated. The button 100 includes a body 102, a cam bar 104, a cam member 106, a rotation bar 108, and a fixture 110. The button 100 may be made of any suitable material such as metal, steel, ceramic, and/or plastic or other polymers. The cam bar 104 may be made of metal, steel or any other suitable material. For example, in some embodiments, tungsten or a tungsten alloy may be used. The fixture may also be made of any suitable material, one example of which is a rigid plastic.

The cam bar 104 generally extends through an aperture 116 formed in the body 102, and runs internally though the entire length or substantially the entire length of the body 102. The cam member 106 is coupled to the cam bar 104 and the rotation bar 108. The cam bar 104 and the rotation bar 108, however, extend in opposite directions from the cam member and are offset from each other, so that their major axes (e.g., lengths) are parallel to each other. The fixture 110 may couple the rotation bar 106 to a device housing in which the button 100 is installed.

Figure 5:
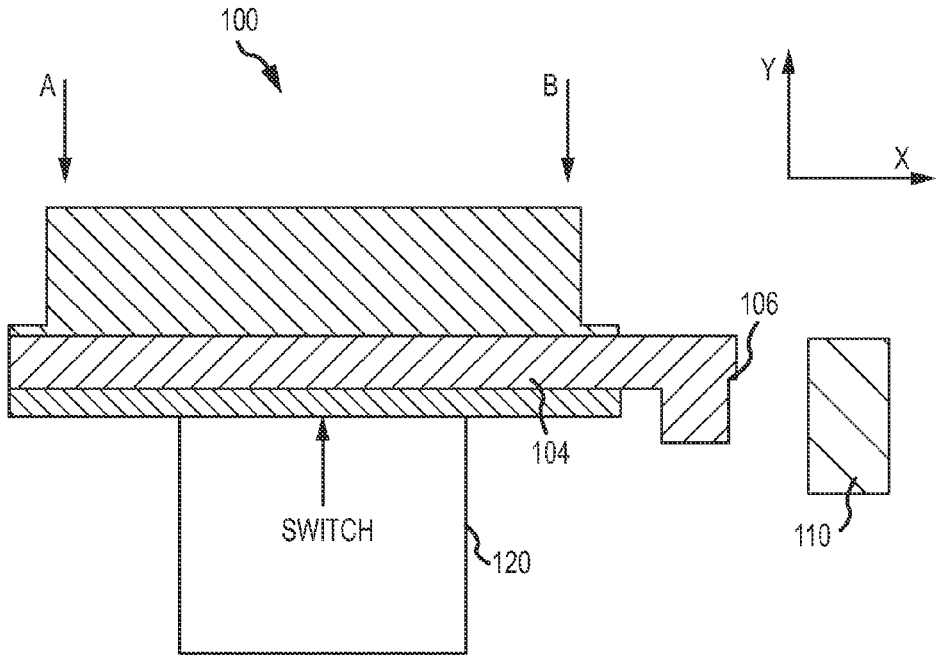
FIG. 5 is a cross-sectional view taken along line V-V of the button in FIG. 1.
Figure 6:
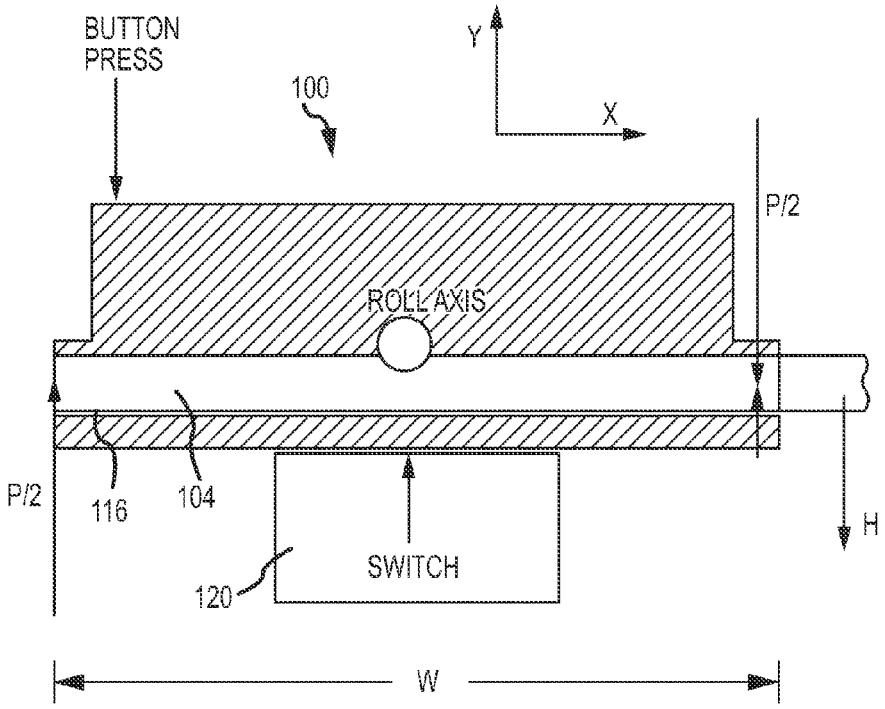
FIG. 6 is a partial view of the cross-sectional view of FIG. 5 showing forces acting on the button.

It should be appreciated that a coordinate system is also set forth in FIG. 1 that is carried through FIG. 6. In FIGS. 1-6, the cam bar 104 extends lengthwise in the x-axis, the button moves along the y-axis, and the cam bar moves within an aperture in the z-direction.

Figure 2:
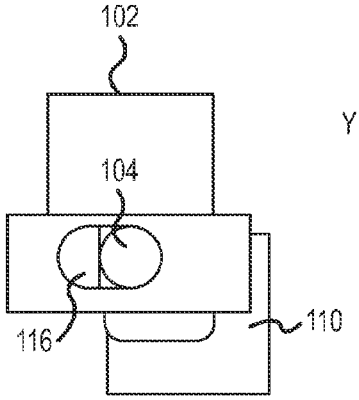
FIG. 2 is an end view taken from the left side of the button of FIG. 1.
Figure 3:
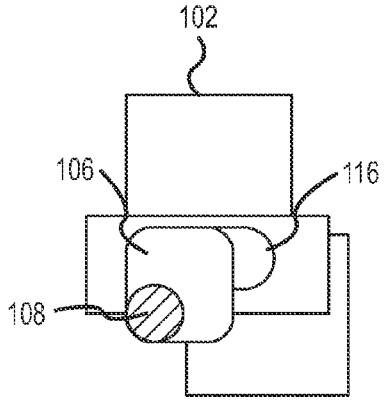
FIG. 3 is a cross-sectional view taken along line III-III of the button in FIG. 1.

FIG. 2 is an end view from left side in FIG. 1 and FIG. 3 is a cross-sectional view taken along line III-III in FIG. 1. In FIG. 2, the cam bar 104 can be seen within the body 102 of the button 100. In FIG. 3, the cam member 106 is shown as being a square plate (referred to herein as a "cam plate") with the rotation bar 108 located in its lower left hand corner. The cam bar 104 (not seen in FIG. 3) is located on the upper right hand corner on the side of the cam member 106 opposite the rotation bar 108, in order to provide both a vertical and horizontal offset of the two bars.

Figure 4:
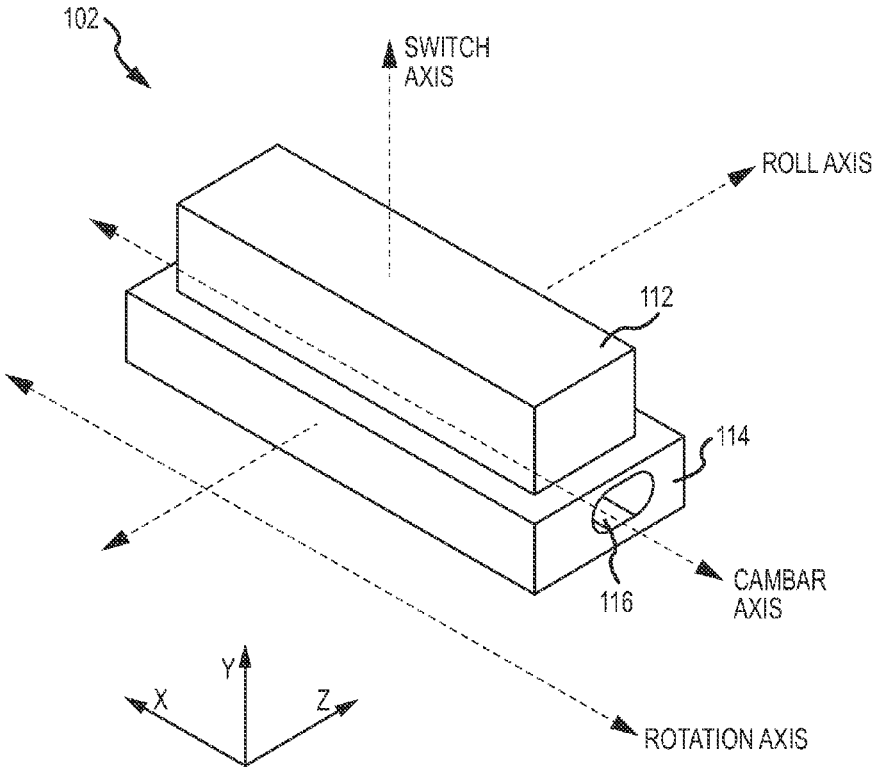
FIG. 4 illustrates a body of the button of FIG. 1.

FIG. 4 illustrates the body 102 of the button 100 without the cam bar 104, cam plate 106 or rotation bar 108 installed. The body 102 may generally include two sections, namely an upper section 112 and a lower section 114. The upper section 112 typically may be the portion of the button 100 accessible to a user and with which the user interacts. In some embodiments, the lower portion 114 may be larger than the upper portion 112. In particular, the lower portion 114 may extend beyond an outer perimeter of the upper portion 112, as illustrated. In other embodiments, the lower portion 114 may include one or more flanges to engage a housing of an electronic device in which the button is installed. It should be appreciated that in other embodiments, there is no artificial distinction between portions of the button. That is, a button may take a form that has a substantially uniform size and/or shape, such as a cylinder.

It should be appreciated that the body 102 may take various different forms and may be manufactured through any suitable process. For example, the body 102 (e.g., upper and lower portions 112, 114) may be cut from a single block of material, such as a single block of aluminum or plastic for example, in accordance with known machining techniques. In other embodiments, the body 102 may be formed in a molding process known in the art. In still other embodiments, the upper portion 112 and lower portion 114 may be cut/formed in separate processes and subsequently joined together to form the body 102.

The body 102, and more particularly the lower portion 104, includes a slot or aperture 116 that extends through the length of lower portion or substantially through the length of the lower portion. The aperture 116 may generally have an oval shape in cross-section and is normal in both length and width to the direction of movement of the button. In other embodiments, the aperture may take different shapes, such as a rectangle or other suitable shape. For example, the button 100 may move vertically when depressed (e.g., along the switch axis) and the oval shape may be horizontally disposed within the body 102 so that it is normal to the direction of movement.

As discussed above, it is common for buttons to have a roll axis which may be near the center of the button 100 and about which the button rotates when pressure is disproportionately applied to one side of the button. To prevent roll by the button 100, the cam bar 104 extends through the aperture 116 (the axis is shown in FIG. 2 as extending through the body 102). The cam bar 104 is fixed to the cam 106, so that as the rotation bar rotates, the cam bar is forced to translate along the width of the slot. This happens if the heights (e.g., Z-axis dimension) of the aperture 116 and cam bar 104 are substantially the same. In some embodiments, an edge on the cam bar 104 is provided (not shown). For example, the cam bar 104 may have a substantially flat surface and/or may be square or rectangular. If the cam bar is smaller than the dimensions of the aperture 116, the button can move up or down a bit without engaging the cam bar. In some embodiments, the cam bar may be fixed or rotational with respect to the cam plate. In some embodiments, it may be useful to have a rotating cam bar so that the cam bar can "roll" along the aperture 116 and thus decreases friction or resistance when the button is pressed.

FIG. 5 is a cross-sectional view taken along line V-V of the button 100 in FIG. 1. As may be seen in the cross-sectional view, the cam bar 104 extends the entire length of the body of the lower portion 114 of the body 102. The cam bar fully fills the aperture in this view and so the aperture/spacing is not visible in this particular cross-section. Thus, in this embodiment, the cam bar 104 extends beyond the length of the upper portion 112 of the body 102. In other embodiments, the cam bar may extend along substantially the length of the upper portion 112 of the body. The cam bar 104 in conjunction with the cam action provided by the anti-roll mechanism prevents roll of the button when pressure (illustrated as "a" and "b" with arrows) is applied to the button.

The cam action is described in greater detail below. However, the offset of the cam bar 104 from the rotation bar 108 is shown in FIGS. 1, 2, and 3. Specifically, the axis of the rotation bar 108 is parallel to the rotation and cam bar axes labeled in FIG. 4, but is laterally offset from the cam bar axis. In FIG. 5, a cross-section of the cam bar 104 is shown, while the rotation bar 108 is not shown due to the offset between the cam bar and the rotation bar.

A switch 120 may be installed adjacent to the lower portion 114 of the body 102 (e.g., under the button 100) so that when pressure is applied to the upper portion 112 the switch actuates. Additionally, the switch may exert a spring force to return the button 100 to a resting position after the pressure is removed from the upper portion of the button.

FIG. 6 is a partial view of the cross-sectional view of FIG. 5 showing the forces that may be applied when the button is pressed. The "button press" is represented as a vector directed downward on the left side of the button. Without the anti-roll mechanism and the cam bar 104, pushing the button on one side, as shown would result in roll of the button about the roll axis.

The angle of the roll of the button 100 may be represented as: $\theta_{roll}=\tan(2\,h/w)$, where h is the distance of displacement of the button when pressed (e.g., the travel of the button), and w is the width of the button. With the cam bar and the anti-roll mechanism, however, roll is precluded.

Ideally, the forces applied when the button is pressed would be perfectly distributed across the button 100 and the cam bar 104. In operation, this is rarely the case. In this figure, the forces are shown as two separate forces (P/2) at each end of the cam bar 104. The force vector P/2 on the left side (i.e., the same side as where the button is pushed) represents the cam bar resisting the roll of the button. The force vector P/2 on the right side (opposite side from where pressure is applied) represents the pressure pushing the button and cam bar downward on the right side. The bar provides a restoring force represented by $P=2\cdot\theta_{roll}\cdot E\cdot I/w^2$, which represents the bending stiffness of the cam bar where I is the second area moment related to the cross-sectional of the cam bar and E is the modulus of the bar material. As may be appreciated, the wider the cam bar is, the weaker the restoring forces. In FIG. 6 the restoring force is represented by two forces, each P/2.

Figures 7A, 7B, 7C, 7D:
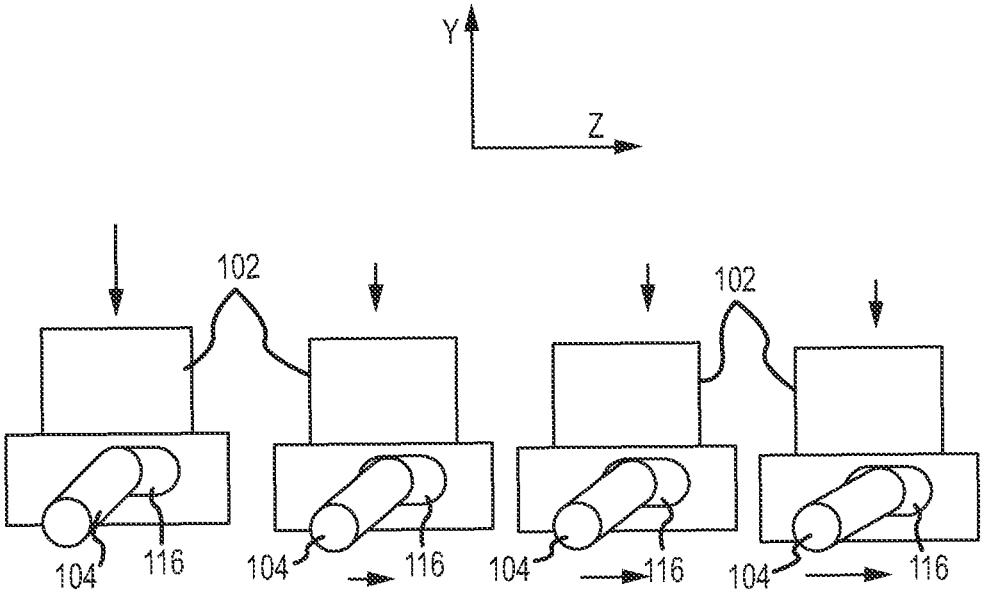
FIGS. 7A-7D illustrate the progressive lateral movement of a cam bar within a slot when the button is pressed.

FIGS. 7A-7D are cross-sectional views of the cam bar taken from the edge of the cam plate and illustrate the movement of the cam bar 104 within the aperture 116 when the button 100 is pressed. Initially, when the button 100 is pressed, the cam bar 104 is located on a first side of the aperture 116 (FIG. 7A). As the button 100 is moved downward, the cam bar 104 moves from the first side to the other side (FIG. 7B-7D). This movement of the cam bar is accommodated by rotation of the cam bar about the rotation axis. Specifically, as pressure is applied to the button, forcing the button downward, the cam bar translates horizontally within the aperture to accommodate the downward motion. The horizontal and downward movement of the cam bar causes the cam plate to rotate about the rotation axis. In some embodiments, the rotation bar, and/or fixation plate may rotate with the cam plate.

The rotation about the rotation axis may be accomplished through a variety of different suitable selections. In one embodiment, the rotation bar is rotationally coupled to the cam member 106 and the cam member and the cam bar 104 may be configured to rotate. In another embodiment, the rotation bar may be configured to rotate either through a rotational coupling with the fixture or the housing. In still other embodiments, the fixture may be rotationally coupled to the housing. It should be appreciated that one or more rotational couplings may be implemented to achieve the desired cam action. It should be appreciated that the anti-roll mechanism may be coupled directly to a sidewall of a device housing via the rotation member or fixture, or in other embodiments, may be coupled to the housing via suitable support structures that allow for both the anti-roll mechanism and the button to be fixed within the housing.

It should be appreciated that the various parts of the cam action anti-roll mechanism can take various different forms. Furthermore, the various different parts may be coupled together in various different manners. For example, in some embodiments, the cam bar and the cam member may be a unitary member. In other embodiments, the cam member and the rotation bar may be a unitary member. Additionally, the cam member may take different shapes to provide a suitable offset for the cam bar and the rotation bar.

Figure 8:
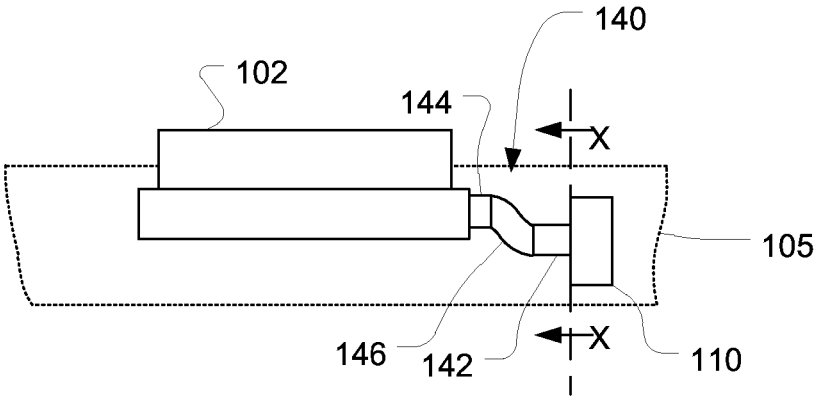
FIG. 8 illustrates an alternative embodiment of a cam action, anti-roll button having a wire member.
Figure 9:
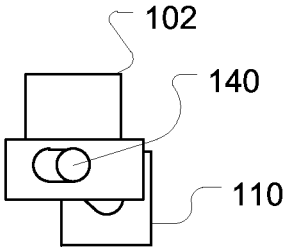
FIG. 9 is an end view taken from the left side of the button of FIG. 8.
Figure 10:
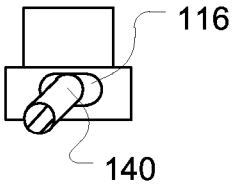
FIG. 10 is a cross-sectional view taken along line X-X of the button of FIG. 8.

FIG. 8 illustrates an alternative embodiment having a wire member 140 providing the cam action. A cam bar 142 and a rotation bar 144 are different segments of the wire member 140 and the cam member 146 is an s-curve in the wire member. FIG. 9 illustrates end view of the wire member embodiment taken from the left side end of FIG. 8. FIG. 10 is a cross-sectional view taken along line X-X of FIG. 8 and showing the wire member 140 inserted into the aperture 116 of the body 102.

In the wire embodiment, the rotation member 144 is either rotationally coupled to the housing 105 or the fixture, or the fixture is rotationally coupled into the housing 105 so that the wire member may rotate about the rotational axis.

Figure 11:
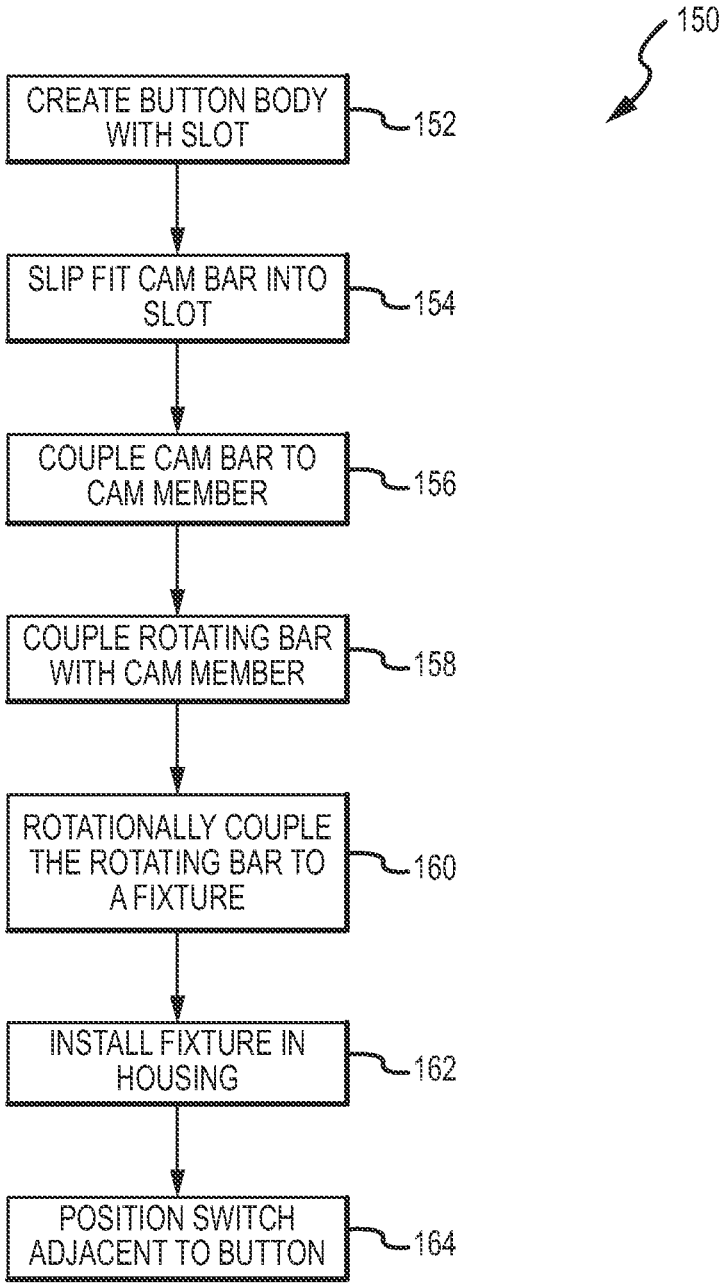
FIG. 11 is a flow chart illustrating a method of manufacturing the cam action, anti-roll button of FIG. 1.

FIG. 11 is a flowchart illustrating a method of manufacture 150. The method may begin by creating the body 102 of the button 100 (Block 152). The body 102 may be cut, molded, and/or assembled to achieve a desired shape and to provide the aperture 116. The cam bar 104 may then be inserted into the aperture 116 (Block 154). The cam bar 104 is slip fitted within the aperture 116 and configured to move laterally within the aperture when the button is pressed. The method also includes coupling the cam bar to a cam member (Block 156) and then coupling a rotating bar to the cam member (Block 158). The rotating bar may be coupled rotationally coupled to a fixture (Block 160) and the fixture is coupled to a housing (Block 162) so that the rotating bar may rotate about a rotational axis when the button 100 is pressed. A switch is also installed under the button so that it is actuated when the button 100 is pressed (Block 164).

Although the foregoing discussion has presented specific embodiments, persons skilled in the art will recognize that changes may be made in form and detail without departing from the spirit and scope of the embodiments. Accordingly, the specific embodiments described herein should be understood as examples and not limiting the scope thereof. For example, the button need not be rectangular, but can be round, ovoid, and so forth. Further, the button can be incorporated into keyboards, trackpads, portable mobile devices like tablets and phones and so on.

The invention claimed is:

1. A one-sided anti-roll button comprising:

an elongated body comprising an aperture extending lengthwise therethrough;

a cam bar extending through the aperture and coupled thereto in a slip fit manner, the cam bar being configured to move within the aperture as the button moves within its axis of motion;

a cam member coupled to the cam bar, the cam bar extending substantially perpendicular in a first direction therefrom; and a rotational bar coupled to the cam member and extending substantially perpendicular to the cam member in an opposite direction from the first direction thereby forming a step shape with the cam bar and cam member, the rotational bar being offset from and parallel to a line that contains the cam bar.

2. The one-sided anti-roll button of claim 1, wherein the cam member comprises a cam plate.

3. The one-sided anti-roll button of claim 1, wherein the cam member comprises an s-shaped bar.

4. The one-sided anti-roll button of claim 1 comprising a fixture coupled to the rotational bar and configured to be coupled to a housing.

5. The one-sided anti-roll button of claim 4, wherein the rotational bar is rotationally coupled to the fixture.

6. The one-sided anti-roll button of claim 4, wherein the rotational bar is rotationally coupled to the cam member.

7. The one-sided anti-roll button of claim 1, wherein the body comprises:

an upper member; and a lower member adjacent the upper member, the aperture extending through the lower member.

8. The one-sided anti-roll button of claim 7, wherein the lower member extends beyond an outer perimeter of the upper member.

9. The one-sided anti-roll button of claim 7, wherein the lower member comprises at least one flange.

10. A button configured to depress along an activation axis, the button comprising:

an elongated body;

an aperture extending lengthwise into the elongated body and defining a cam bar axis;

a cam bar extending configured to move within the aperture about the cam bar axis as the button moves along the activation axis;

a cam plate positioned eccentric to the cam bar axis and coupled to the cam bar at a top corner of the cam plate;

a rotational bar extending from the plate from a bottom corner of the plate diagonally opposed to the top corner, the rotational bar extending away from the elongated body; and an electrical switch positioned below the elongated body and configured to depress along the activation axis of the anti-roll button and to provide a spring force along the activation axis in a direction opposite the direction the button depresses.

11. The button of claim 10 comprising a fixture coupled to the rotational bar and configured to be coupled to a housing.

12. The button of claim 11, wherein the rotational bar is rotationally coupled to the fixture.

13. An anti-roll button configured to depress along an activation axis, the anti-roll button comprising:

a body;

an aperture extending lengthwise through the body and defining a cam bar axis;

a cam bar extending at least partially into the aperture and coupled thereto in a slip fit manner and configured to move within the aperture about the cam bar axis as the button moves along the activation axis;

a plate coupled to the cam bar at a top corner of the plate; and a rotational bar extending from the plate from a bottom corner of the plate diagonally opposed to the top corner, the rotational bar extending away from the body.

14. The anti-roll button of claim 13, wherein the cam bar, the plate, and the rotational bar are formed as an integral element.

15. The anti-roll button of claim 13 comprising a fixture coupled to the rotational bar and configured to be coupled to a housing.

16. The anti-roll button of claim 15, wherein the rotational bar is rotationally coupled to the fixture.

17. The anti-roll button of claim 15, wherein the rotational bar is rotationally coupled to the cam member.

18. The anti-roll button of claim 13, wherein the body comprises:

an upper member; and a lower member adjacent the upper member, the aperture extending through the lower member.

19. The anti-roll button of claim 18, wherein the lower member extends beyond an outer perimeter of the upper member.

* * * * *